US010233594B1

(12) United States Patent
Remington

(10) Patent No.: US 10,233,594 B1
(45) Date of Patent: Mar. 19, 2019

(54) SWITCH POINT GUARD CASTING, ASSOCIATED SUPPORT AND FULL GAGE SWITCH PANEL CONTAINING SAME

(75) Inventor: James A. Remington, Sheffield Village, OH (US)

(73) Assignee: Cleveland Track Material, Inc., Cleveland, OH (US)

( * ) Notice: Subject to any disclaimer, the term of this patent is extended or adjusted under 35 U.S.C. 154(b) by 862 days.

(21) Appl. No.: 13/327,197

(22) Filed: Dec. 15, 2011

(51) Int. Cl.
*E01B 7/02* (2006.01)
*E01B 5/18* (2006.01)

(52) U.S. Cl.
CPC . *E01B 7/02* (2013.01); *E01B 5/18* (2013.01)

(58) Field of Classification Search
CPC ..... E01B 7/20; E01B 5/18; E01B 9/60; E01B 5/14
USPC ..... 238/17; 246/456, 435 A, 441; 104/243
See application file for complete search history.

(56) References Cited

U.S. PATENT DOCUMENTS 690,597 A * 1/1902 Meader ..... 104/243
910,027 A * 1/1909 Stickel ..... 238/17
1,161,741 A 11/1915 Smoter
1,163,431 A 12/1915 Maranda et al.
1,230,533 A 6/1917 Stiles
1,463,943 A 8/1923 Fallon
1,481,765 A * 1/1924 Wentling ..... 238/17
1,872,848 A 8/1932 Told
3,026,074 A 3/1962 Kern
3,063,641 A 11/1962 Frey
4,355,776 A 10/1982 Rydin
4,386,751 A 6/1983 Meyer
4,566,630 A 1/1986 Keiper, Jr.
4,738,418 A 4/1988 Farrell
5,115,970 A 5/1992 Rice et al.
5,169,064 A 12/1992 Rice et al.
7,137,601 B2 11/2006 Christ et al.
8,714,092 B2 * 5/2014 Heitzenrater ..... 104/130.09

OTHER PUBLICATIONS

Switch Point Guard, www.voestalpine.com/nortrak, web page.
Switch Point Protectors & Guards, www.harmersteel.com, web page.
Switch Point Guards, www.rrtools.com, web page.
Guard Rails, Unitrac Railroad Materials, Inc., catalog.

* cited by examiner

*Primary Examiner* — S. Joseph Morano
*Assistant Examiner* — Jean W Charleston
(74) *Attorney, Agent, or Firm* — Ice Miller LLP

(57) ABSTRACT

The invention may be described as including a switch guard casting, a switch guard assembly for a railway intersection, as well as a rail intersection design and a switch guard assembly therefor.

18 Claims, 16 Drawing Sheets

BODY CASTING MACHINING DETAIL

ASSEMBLY DETAIL

SWITCH POINT GUARD CASTING, ASSOCIATED SUPPORT AND FULL GAGE SWITCH PANEL CONTAINING SAME

RELATED APPLICATION DATA

None.

FIELD OF THE INVENTION

The present invention relates to a railroad track and related switching assemblies.

BACKGROUND OF THE INVENTION

The present invention relates to a switching assembly for a railway switch and rail arrangement. A railway switch is employed where one track diverges from another. This invention relates to a switch point guard casting for use adjacent the switch point of railway switches in trackwork.

Typically, railroad switching components are some of the highest maintenance portions of a railroad track arrangement as they must endure repetitive impact and stress, as well as extreme inertial forces attendant to lateral disposition of the running wheels and the loads they bear.

The switching rail of a railway switch assembly includes a tapered rail portion which terminates into a thin end point for intercepting and switching the wheels of rolling stock from one rail onto another.

Because such switch point guards engage the wheel flanges at an angle and urge the wheel toward a new route as it proceeds through the switch region, they experience considerable wear due to the repeated contact between the moving wheels and the wheel engaging surface of the guard rail. These castings are designed to capture the wheel and direct it through the switching zone.

In prior art arrangements, switch point guards used a simple, straight lateral surface to urge the wheels into and through their required course through the switching region. In such arrangements, such switch point guards also carried the risk of derailment because their lateral surfaces rub against the engaging wheel and can cause the wheel to ride up the lateral surface, which may lead to a raising of the wheel through a ramping effect as the side of the wheel creeps up the side of the casting. This causes either violent re-leveling of the wheel as the friction of the wheel against the casting gives way to gravity (leading to repetitive impact events that wear the track work and wheels alike) or, in extreme cases, to derailment should the wheel be raised to a point where it loses the capture of the wheel flange.

It is also best to provide a uniform, secure wheel path that distributes load and reduces wheel and guard wear, while reducing the risk of wheel ride-up and derailment.

The embodiments of the invention described herein address the shortcomings of the prior art.

SUMMARY OF THE INVENTION

In general terms, the invention may be described as including a switch guard casting, a switch guard assembly for a railway intersection, as well as a rail intersection design and a switch guard assembly therefor.

The present invention may be used for single and multiple switches as will be appreciated from the description and drawings.

The present invention thus provides several concomitant advantages over the prior art. The system of the present invention allows the required capture and guidance of the approaching wheel as it is presented while travelling through the switch region.

In addition, the switch guard casting and its arrangement also allow the engaging surface of the approaching wheel to be guided through the switch region with reduced risk of ride-up along a substantial portion of the run-through distance such that risk of violent re-leveling or derailment is substantially reduced.

The present invention also includes a switching system which may be assembled as a complete unit at a manufacturing site and transported to its intended installation site. This allows for greater control of manufacturing costs and allows the operator to obtain a completed switching assembly that may be produced using relatively small and simple frog castings that can be installed on site.

In operation, the system of the present invention also provides for a secure wheel path and it accepts and allows the wheel to move through the respective intersecting region.

Rail crossing systems of the present invention may be incorporated with canted rail systems that allow for speeds as high as 50-60 mph where desirable.

The several aspects of the present invention may be summarized as follows.

In general terms the present invention includes a switch guard casting, switch guard assemblies and a panel arrangement, as well as a crossing constructed thereby.

Switch Point Guard Casting

In general terms the present invention includes a switch point guard casting comprising a main line body portion having a lateral guide surface, the lateral guide surface having, in series: (a) an entry section defining an entry section curved line; (b) a central section defining a substantially straight line; and (c) an exit section defining an exit section curved line.

The entry section curved line and exit section curved line may be of any curvature, though preferably are selected from the group consisting of continuous curvature lines and progressive curvature lines. It is most preferred that the entry section curved line and the exit section curved line are selected from the group consisting of continuous curvature lines with a radius in the range of from about 40 feet to about 150 feet; though the entry section curved line and the exit section curved line may be selected from the group consisting of progressive curvature lines with radii varying in the range of from about 40 feet to about 150 feet.

Switch Point Guard Casting and Support

The present invention also includes a switch point guard casting and associated support, adapted to be attached to a series of railroad ties, comprising: (a) a switch point guard casting having main line body portion having a lateral guide surface, the lateral guide surface having, in series: (i) an entry section defining an entry section curved line; (ii) a central section defining a substantially straight line; and (iii) an exit section defining an exit section curved line; and (b) a tie plate attached to two of the railroad ties; and (c) a support piece attached to the switch point guard casting and adapted to be affixed to the tie plates.

The entry section curved line and the exit section curved line may be as described above.

Typically, the support piece will be in the form of a bridge-shaped piece adapted to be attached to the switch point guard casting and adapted to be affixed to respective tie plates of two corresponding ties, while allowing a central tie to extend therebetween.

Full Gage Railroad Panel with Switch Point Guard Casting and Support

The invention also includes in its preferred embodiment a full gage railroad panel comprising a switch point guard casting and support, adapted to be attached to a series of railroad ties, comprising: (a) a railroad switch panel comprising a series of railroad ties supporting a railway switch arrangement of sufficient size to accommodate the full gage of a railroad track, the track comprising a running rail; (b) a switch point guard casting having main line body portion having a lateral guide surface oriented toward the running rail, the lateral guide surface having, in series (i) an entry section defining an entry section curved line curving away from the running rail; (ii) a central section defining a substantially straight line parallel to the running rail; and (iii) an exit section defining an exit section curved line curving away from the running rail; and (c) a tie plate attached to two of the railroad ties; and (d) a support piece attached to the switch point guard casting and adapted to be affixed to the tie plates.

The entry section curved line and the exit section curved line may be as described above.

DETAILED DESCRIPTION OF THE PREFERRED EMBODIMENTS

Figure 1:
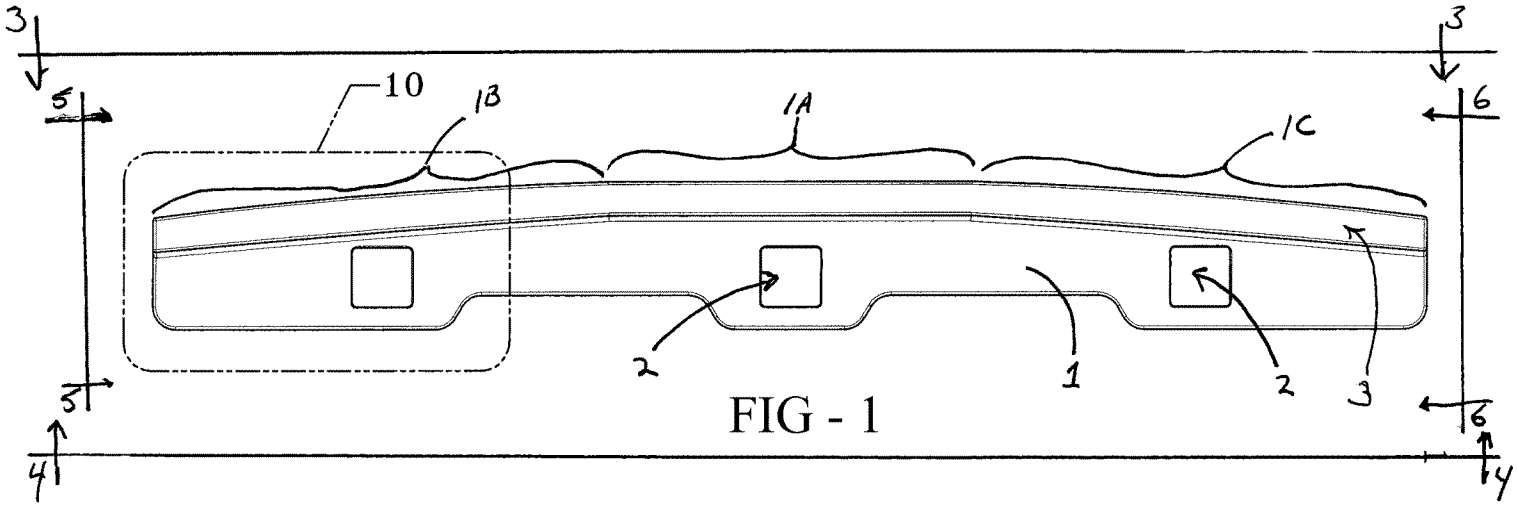
FIG. 1 is a top plan view of a switch point guard casting in accordance with one embodiment of the present invention.

In accordance with the foregoing summary, the following describes a preferred embodiment of the present invention which is considered to be the best mode thereof. With reference to the drawings, the invention will now be described in detail with regard for the best mode and preferred embodiment.

FIGS. 1-26 show, using like reference numerals, a switch point casting, and its associated support, as well as its fixture within a full gage rail panel assembly, in accordance with one embodiment of the present invention.

FIG. 1 is a plan view of a switch point guard casting 1 in accordance with one embodiment of the present invention.

Figure 2:
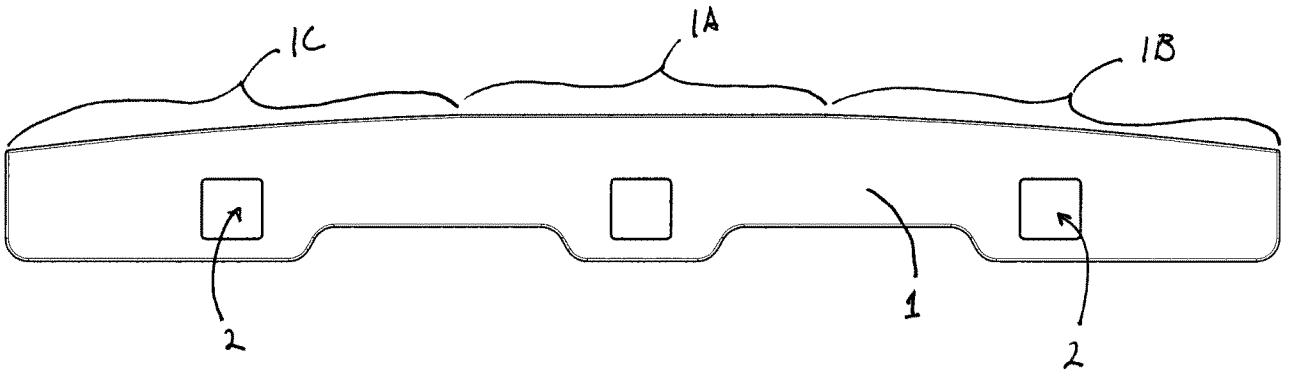
FIG. 2 is bottom plan view of a switch point guard casting and support in accordance with one embodiment of the present invention.

FIG. 2 shows switch point guard casting 1 having central region 2A which is straight, while entry/exit regions 2B and 2C are curved. FIG. 1 shows a top plan view of switch point guard casting 1 having central region 1A and entry/exit regions 1B and 1C, as well as fixture apertures 2. This view shows a relatively thick ridge portion 3 running the length of the rail-facing side of switch point guard casting 1. FIG. 2 shows a bottom plan view of switch point guard casting 1 wherein like reference numerals refer to corresponding elements or features. The bottom surface typically is flat and adapted to be supported on the upper surface of a support structure as described herein.

Figure 3:
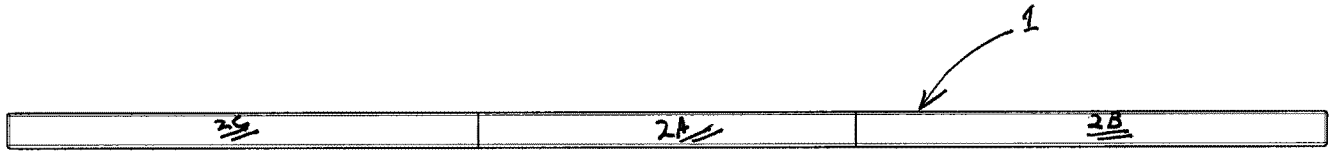
FIG. 3 is a rail-facing side elevation view of a switch point guard casting in accordance with one embodiment of the present invention.

FIG. 3 shows a rail-facing side elevation view of switch point guard casting 1, taken along line 3-3 of FIG. 1, and wherein like reference numerals refer to corresponding elements or features. This view shows the rail-facing sides 2A (corresponding to central region 1A) and curved rail-facing sides 2B and 2C (corresponding to entry/exit regions 1B and 1C, respectively). Rail-facing sides 2B and 2C present a non-linear, preferably continuously curved surface (i.e., most preferably having a constant radius of from about 50 to about 160 feet) or, in the alternative, progressively curved surface (i.e., one whose curvature is formed by a plurality of curvatures that have progressively diminishing radii when moving from the central region to the end of the casting, most preferably varying from about 160 to about 50 feet).

It is preferred that the curvature of entry/exit regions 2B and 2C be identical. The curvatures of the entry/exit regions may be continuous or progressive. In the case of continuous curvatures, the radius of the curvature will typically be in the range of from about 40 feet to 150 feet, although a radius of approximately 100 feet is preferred as it provides a smoother wheel path transition as the wheel enters the guard flare region. It is preferred that the switch point guard has a circular curve entry/exit region with a minimum radius of 50 feet.

In an alternative embodiment, the curvature of the entry/exit regions 2B and 2C may be progressively curved, the respective curvature of a series of sub-regions increasing as they progress from the end of the central region 2A to the respective ends of the casting.

Figure 4:
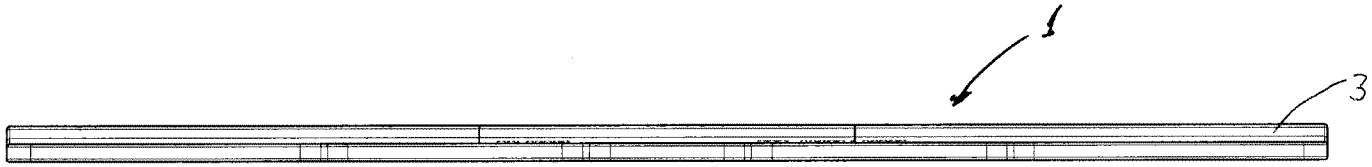
FIG. 4 is an opposite side elevation view of a switch point guard casting in accordance with one embodiment of the present invention.

FIG. 4 shows an opposite side elevation view of switch point guard casting 1 taken along line 4-4 of FIG. 1, wherein like reference numerals refer to corresponding elements or features.

Figure 5:
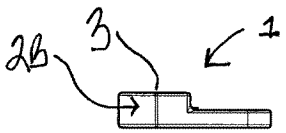
FIG. 5 is a first end elevation view of a switch point guard casting in accordance with one embodiment of the present invention.

FIG. 5 shows a first end elevation view of switch point guard casting 1 taken along line 5-5 of FIG. 1, wherein like reference numerals refer to corresponding elements or features.

Figure 6:
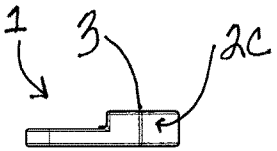
FIG. 6 is a second end elevation view of a switch point guard casting in accordance with one embodiment of the present invention.

FIG. 6 shows a second end elevation view of switch point guard casting 1 taken along line 6-6 of FIG. 1, wherein like reference numerals refer to corresponding elements or features.

Figure 7:
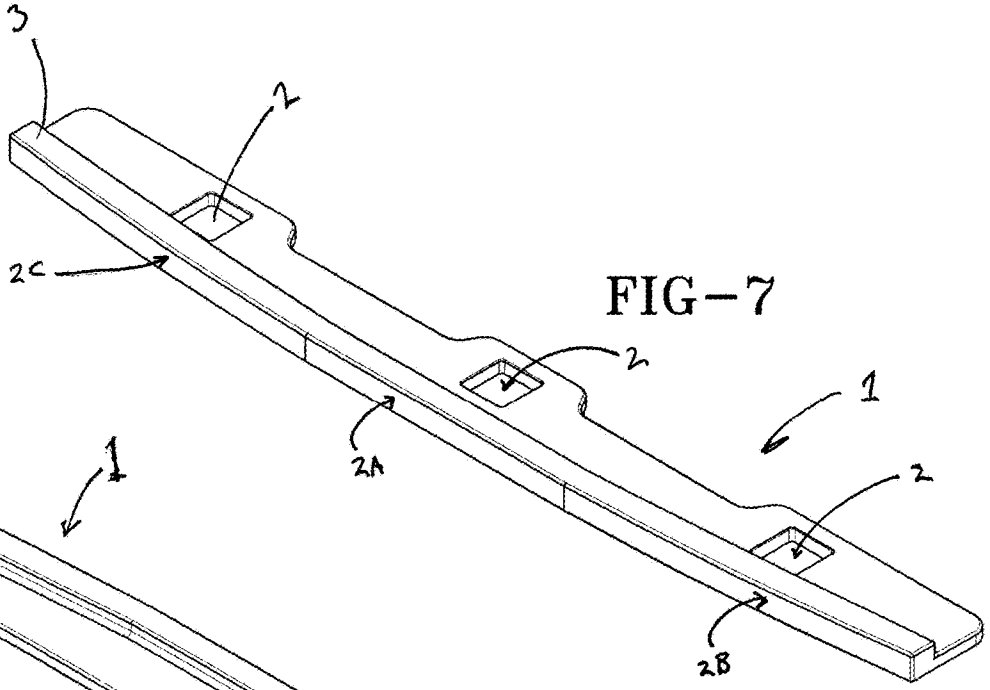
FIG. 7 is a rail-facing side perspective view of a switch point guard casting in accordance with one embodiment of the present invention.

FIG. 7 shows a rail-facing side perspective view of switch point guard casting 1, wherein like reference numerals refer to corresponding elements or features. This view also shows the rail-facing sides 2A (corresponding to central region 1A) and curved rail-facing sides 2B and 2C (corresponding to entry/exit regions 1B and 1C, respectively).

Figure 8:
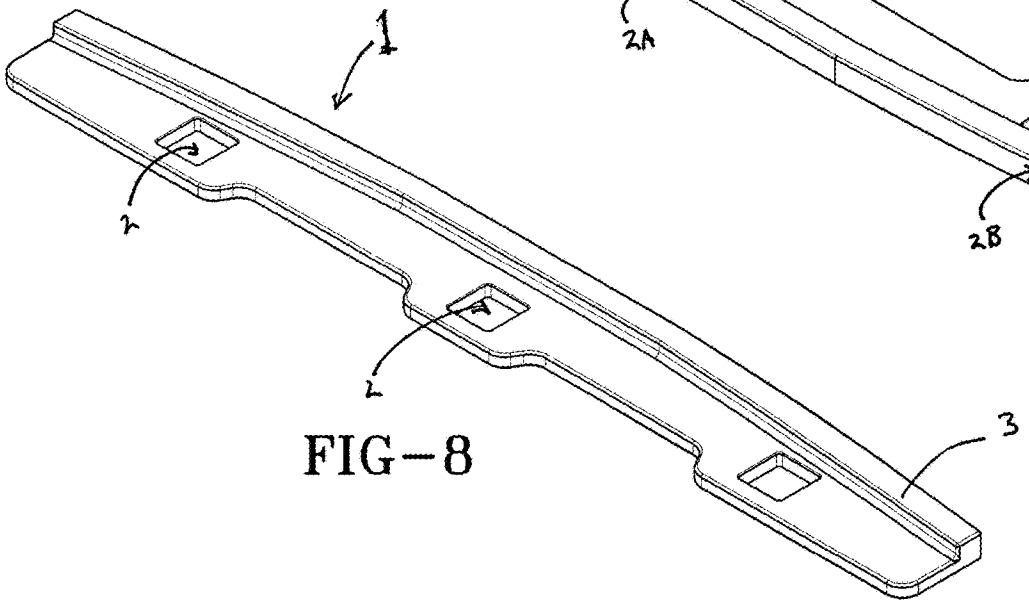
FIG. 8 is an opposite side perspective view of a switch point guard casting in accordance with one embodiment of the present invention.

FIG. 8 shows an opposite side perspective view of switch point guard casting 1, wherein like reference numerals refer to corresponding elements or features. This view also shows central region 1A and entry/exit regions 1B and 1C, as well as fixture apertures 2.

Figure 9:
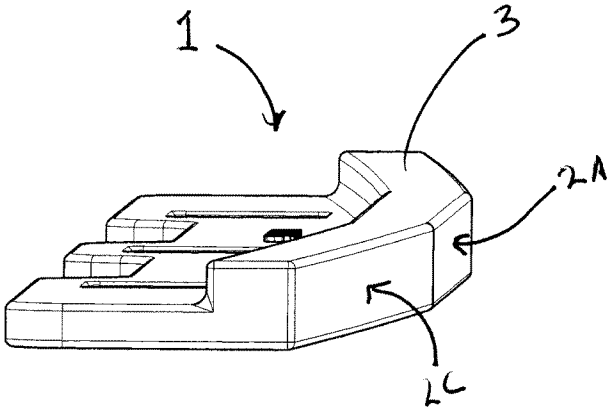
FIG. 9 is a second end perspective view of a switch point guard casting in accordance with one embodiment of the present invention.

FIG. 9 shows a second end perspective view of switch point guard casting 1, wherein like reference numerals refer to corresponding elements or features. This view also shows the rail-facing sides 2A (corresponding to central region 1A) and curved rail-facing sides 2B and 2C (corresponding to entry/exit regions 1B and 1C, respectively).

Figure 10:
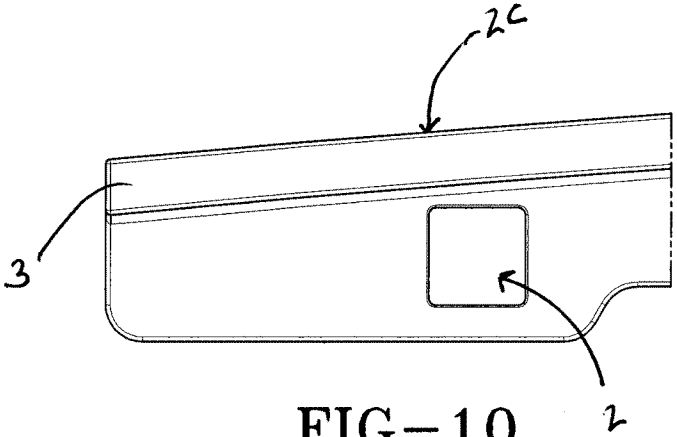
FIG. 10 is a detailed plan view of a portion of a switch point guard casting in accordance with one embodiment of the present invention.

FIG. 10 shows a detail of the top plan view of switch point guard casting 1 of FIG. 1, wherein like reference numerals refer to corresponding elements or features. This view shows curved rail-facing sides 2C (corresponding to entry/exit regions 1C) in more detail.

Figure 11:
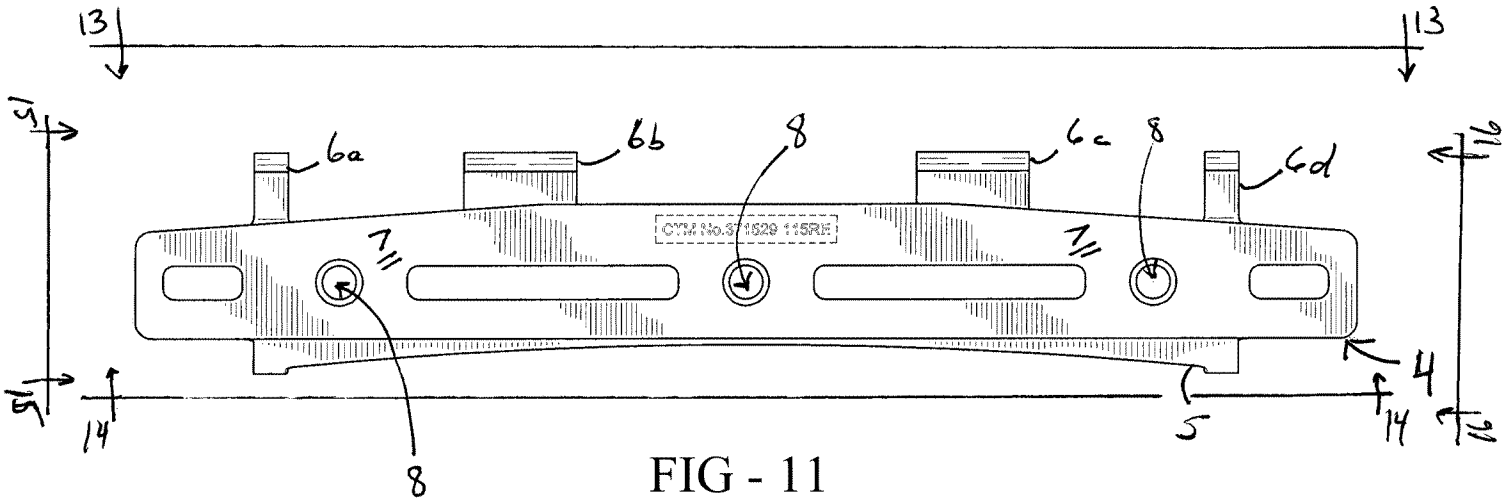
FIG. 11 is a top plan view of a support structure for a switch point guard casting in accordance with one embodiment of the present invention.
Figure 25:
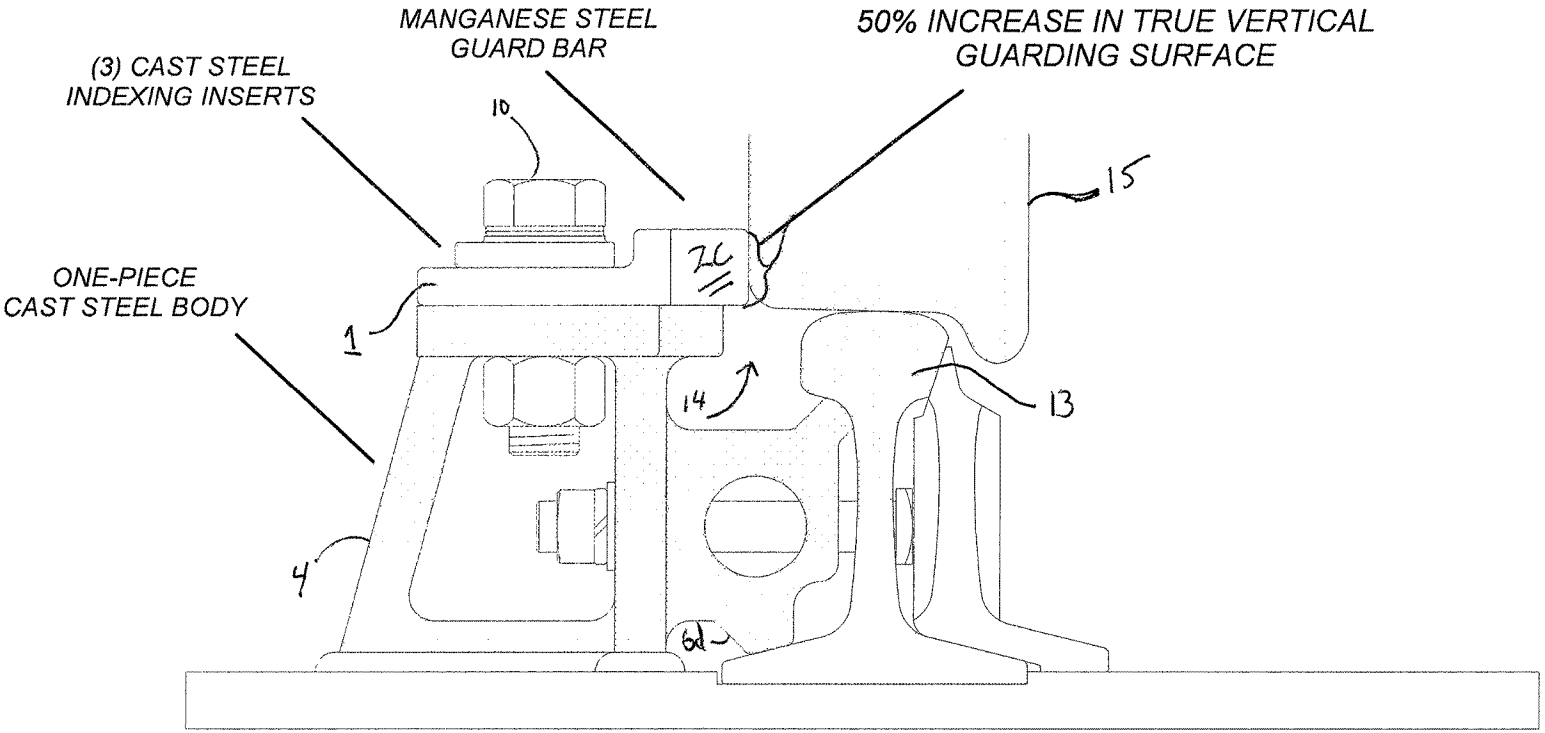
FIG. 25 is an end elevation view of the assembled switch point guard casting and support structure positioned adjacent a railroad rail, attached to a railroad tie attachment plate, and showing the position of a railcar wheel, in accordance with one embodiment of the present invention.

FIG. 11 is a top plan view of the support structure 4 for switch point guard casting 1 in this embodiment of the present invention. This view shows the support structure 4 having an arch-shaped bridge structure 5 and a number of rail-abutting extensions 6*a*-6*d* which engage and attach to a section of the rail (as can be appreciated from FIGS. 22 and 23) at the position where the switch point guard casting is to operate. FIG. 11 also shows flat upper surface 7 which supports the switch point guard casting once installed thereon. The upper surface 7 of support structure 4 also has attachment apertures 8 that correspond to the position of attachment apertures 2 in switch point guard casting 1, allowing it to be fixed by large fasteners (as shown in FIGS. 23 and 25).

Figure 12:
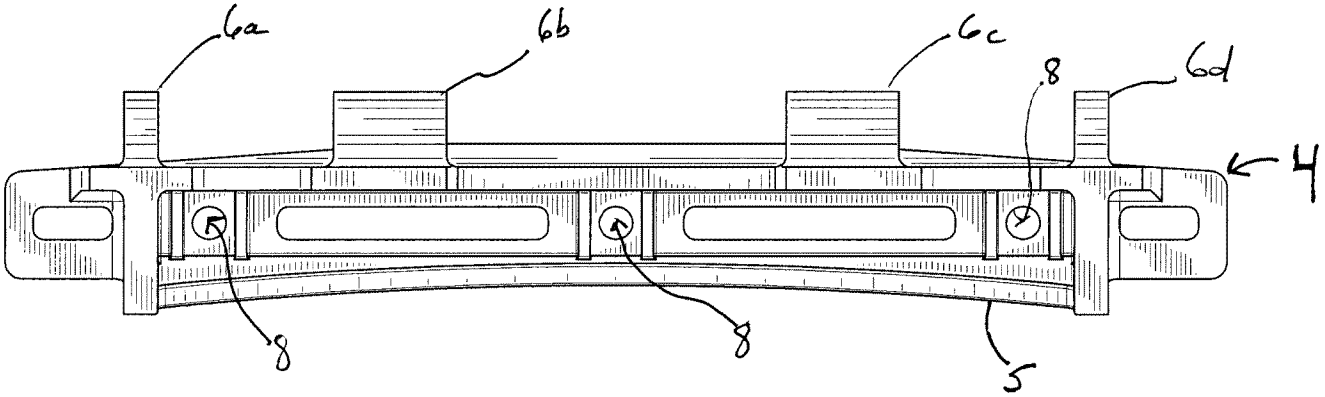
FIG. 12 is a bottom plan view of a support structure for a switch point guard casting in accordance with one embodiment of the present invention.

FIG. 12 shows a bottom plan view of the support structure 4 for a switch point guard casting 1 wherein like reference numerals refer to corresponding elements or features. This view shows arch-shaped bridge structure 5 in greater detail, along with rail-abutting extensions 6*a*-6*d*.

Figure 13:
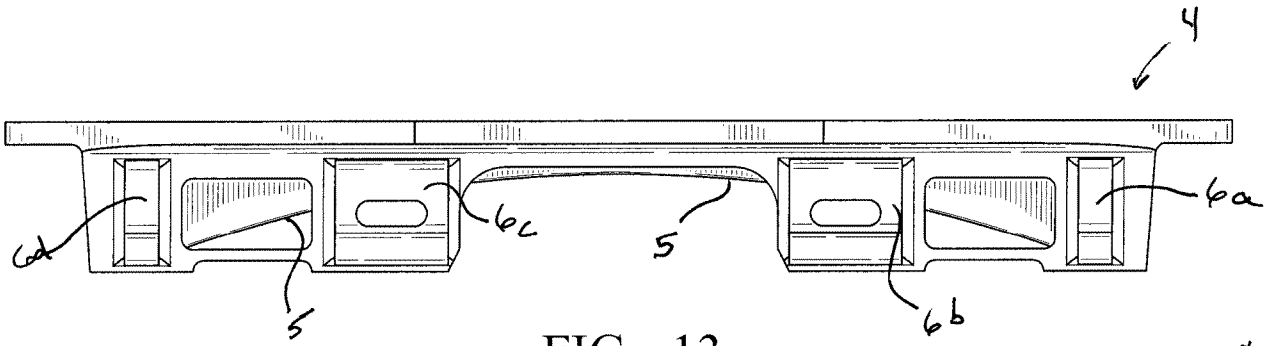
FIG. 13 is a first side elevation view of a support structure for a switch point guard casting, taken along line 13-13 of FIG. 11, in accordance with one embodiment of the present invention.

FIG. 13 is a rail-facing side elevation view of the support structure for a switch point guard casting 1, taken along line 13-13 of FIG. 11, wherein like reference numerals refer to corresponding elements or features. This view shows the rail-abutting extensions 6*a*-6*d* in greater detail.

Figure 14:
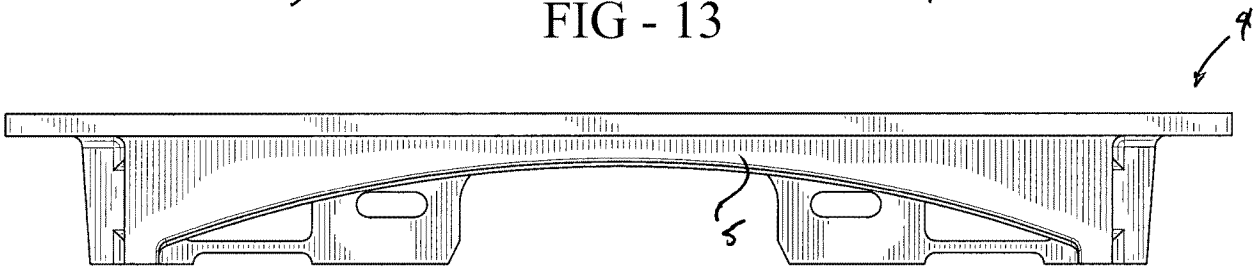
FIG. 14 is a second side elevation view of a support structure for a switch point guard casting, taken along line 14-14 of FIG. 11, in accordance with one embodiment of the present invention.

FIG. 14 is an opposite side elevation view of the support structure 4 for a switch point guard casting 1, taken along line 14-14 of FIG. 11 wherein like reference numerals refer to corresponding elements or features.

Figure 15:
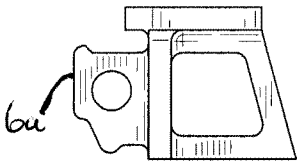
FIG. 15 is a third side elevation view of a support structure for a switch point guard casting, taken along line 15-15 of FIG. 11, in accordance with one embodiment of the present invention.

FIG. 15 is a first end elevation view of the support structure 4 for a switch point guard casting 1, taken along line 15-15 of FIG. 11 wherein like reference numerals refer to corresponding elements or features.

Figure 16:
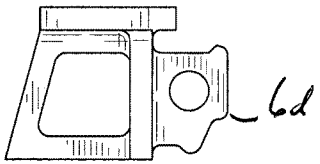
FIG. 16 is a fourth side elevation view of a support structure for a switch point guard casting, taken along line 16-16 of FIG. 11, in accordance with one embodiment of the present invention.

FIG. 16 is a second end elevation view of the support structure 4 for a switch point guard casting 1, taken along line 16-16 of FIG. 11 wherein like reference numerals refer to corresponding elements or features.

Figure 17:
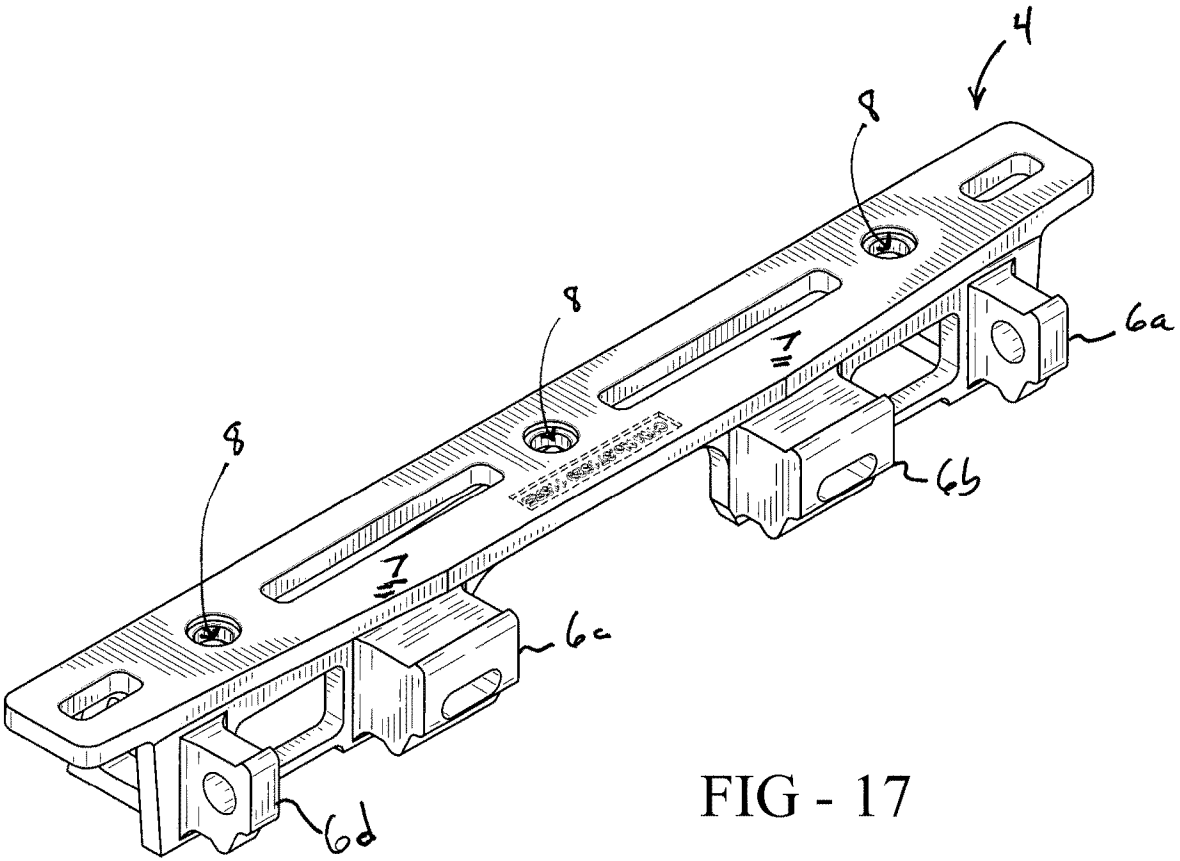
FIG. 17 is a first upper perspective view of a support structure for a switch point guard casting, in accordance with one embodiment of the present invention.

FIG. 17 is a rail-facing side upper perspective view of the support structure 4 for a switch point guard casting 1 wherein like reference numerals refer to corresponding elements or features. This view shows the rail-abutting extensions 6*a*-6*d* in greater detail.

Figure 18:
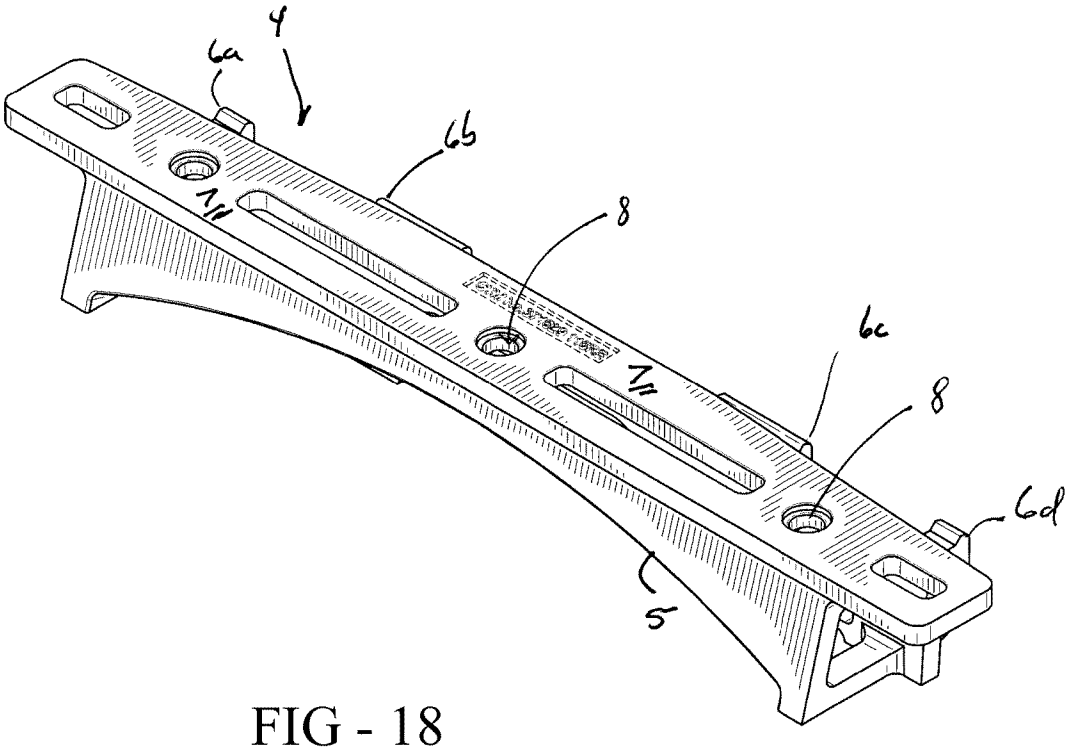
FIG. 18 is a second upper perspective view of a support structure for a switch point guard casting, in accordance with one embodiment of the present invention.

FIG. 18 is an opposite side upper perspective view of the support structure 4 for a switch point guard casting 1 wherein like reference numerals refer to corresponding elements or features.

Figure 19:
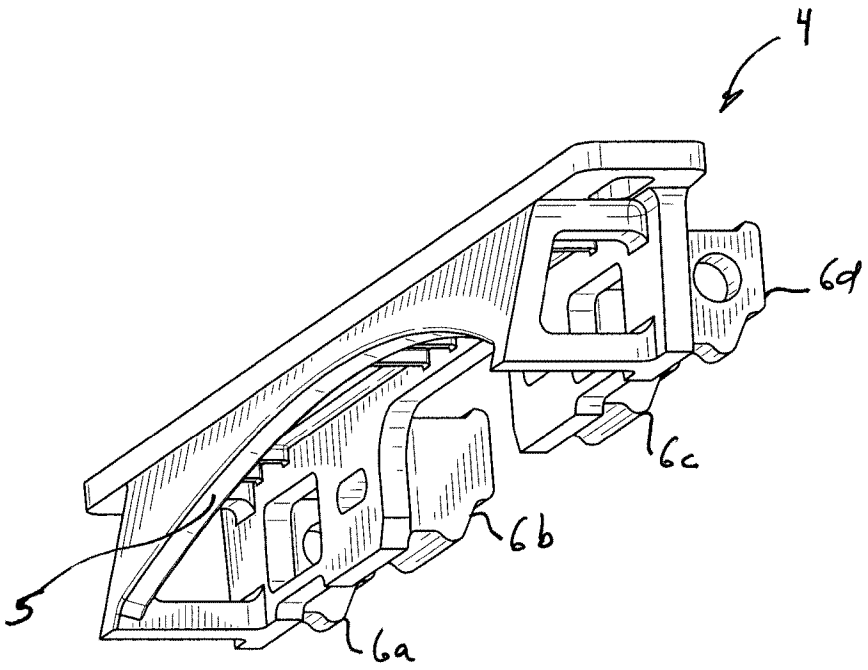
FIG. 19 is a lower perspective view of a support structure for a switch point guard casting, in accordance with one embodiment of the present invention.

FIG. 19 is a lower perspective view of the support structure 4 for a switch point guard casting 1 wherein like reference numerals refer to corresponding elements or features.

Figure 20:
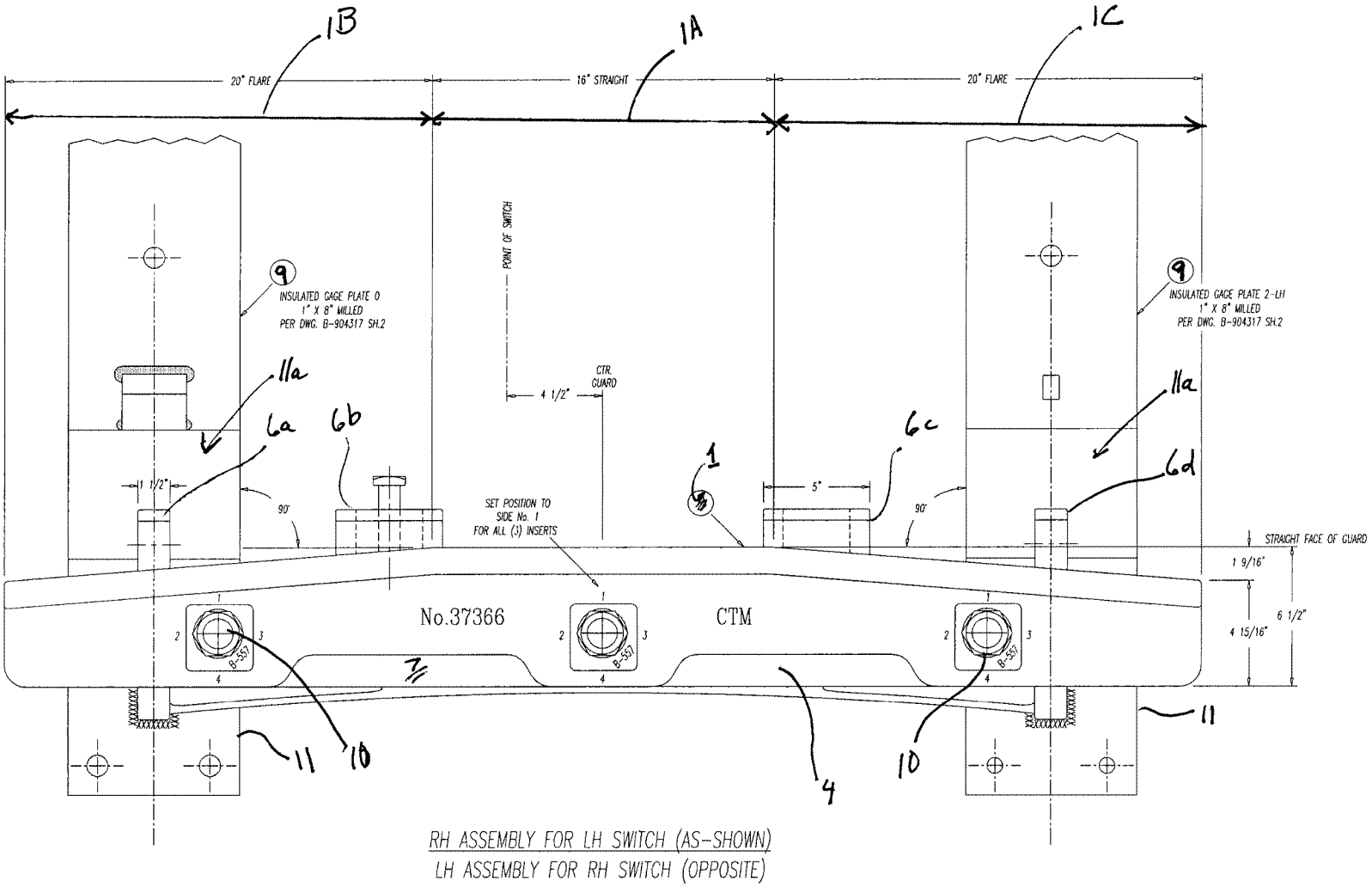
FIG. 20 is a top plan view of the assembled switch point guard casting and support structure, attached by plates onto railroad ties, in accordance with one embodiment of the present invention.

FIG. 20 is a top plan view of the switch point guard casting 1 atop and attached to support structure 4 via fixture nut, bolt and washer assembly 10, which assembly is further attached to a pair of railroad ties 9, through attachment plates 11 to which the support structure 4 may be welded. Attachment plates 11 in turn have grooved areas 11*a* into which a straight rail is laid. In this embodiment of the present invention. This view shows a right hand assembly for a left-handed switch, whereas a corresponding mirror-image left hand assembly may likewise be provided for a right-handed switch.

This view shows central region 1A and entry/exit regions 1B and 1C. In this embodiment, the central region 1A is straight, and typically will be in the range of 16±4 inches in length though other lengths may be used depending upon the specific application. The entry/exit regions 1B and 1C are curved, and typically will be in the range of 20±6 inches in length though other lengths may be used depending upon the specific application. In this embodiment, entry/exit regions 1B and 1C are flared such that the deflection away from the straight line represented by rail-facing side 2A of central region 1A is about 1 9/16 inch, and this deflection may vary with each variation, though the typical deflection ratio is normally in the range of 20:1 to 15:1.

Figure 21:
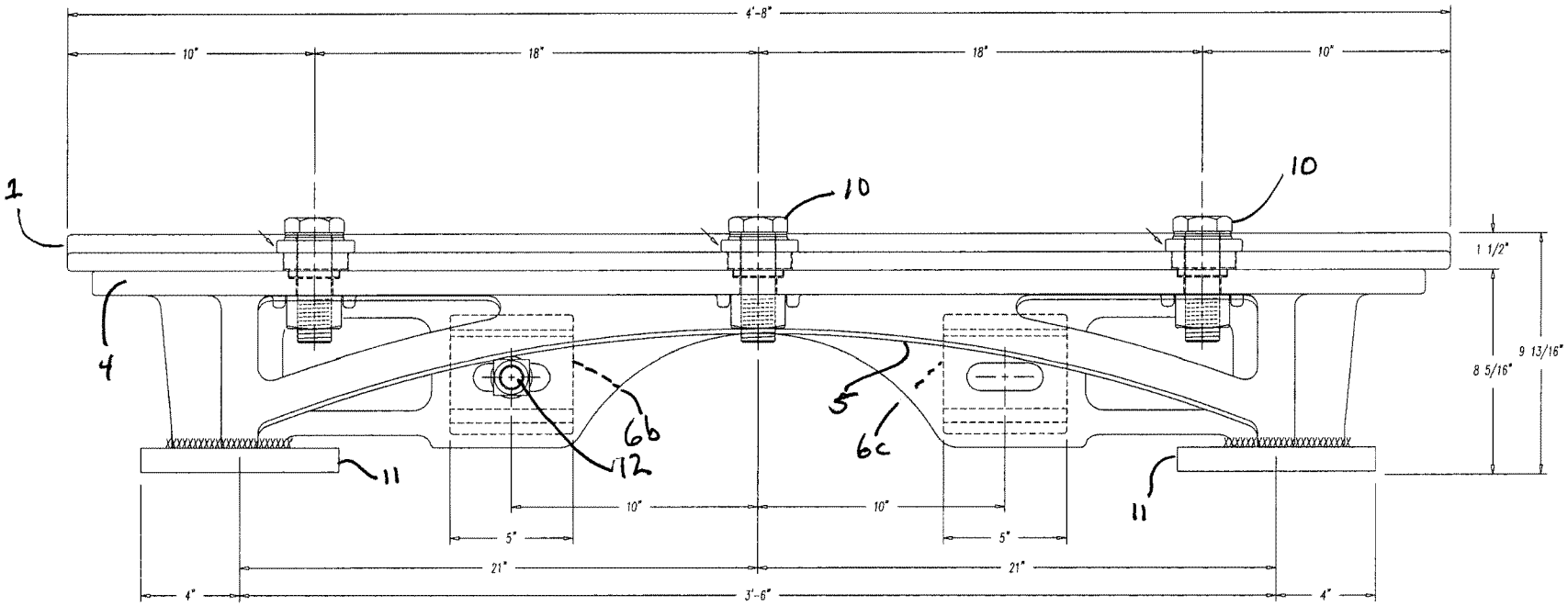
FIG. 21 is an opposite side elevation view of the assembled switch point guard casting and support structure, attached to railroad tie attachment plates, in accordance with one embodiment of the present invention.

FIG. 21 is an opposite side elevation view of the assembled switch point guard casting and support structure, attached to railroad tie attachment plates, in accordance with one embodiment of the present invention. FIG. 21 shows an opposite side elevation of the switch point guard casting 1 atop and attached to support structure 4, wherein like reference numerals refer to corresponding elements or features. This view shows the attachment bolt assembly 12 that attaches the support structure 4 to the adjacent rail via a corresponding aperture placed in the rail (not shown).

Figure 22:
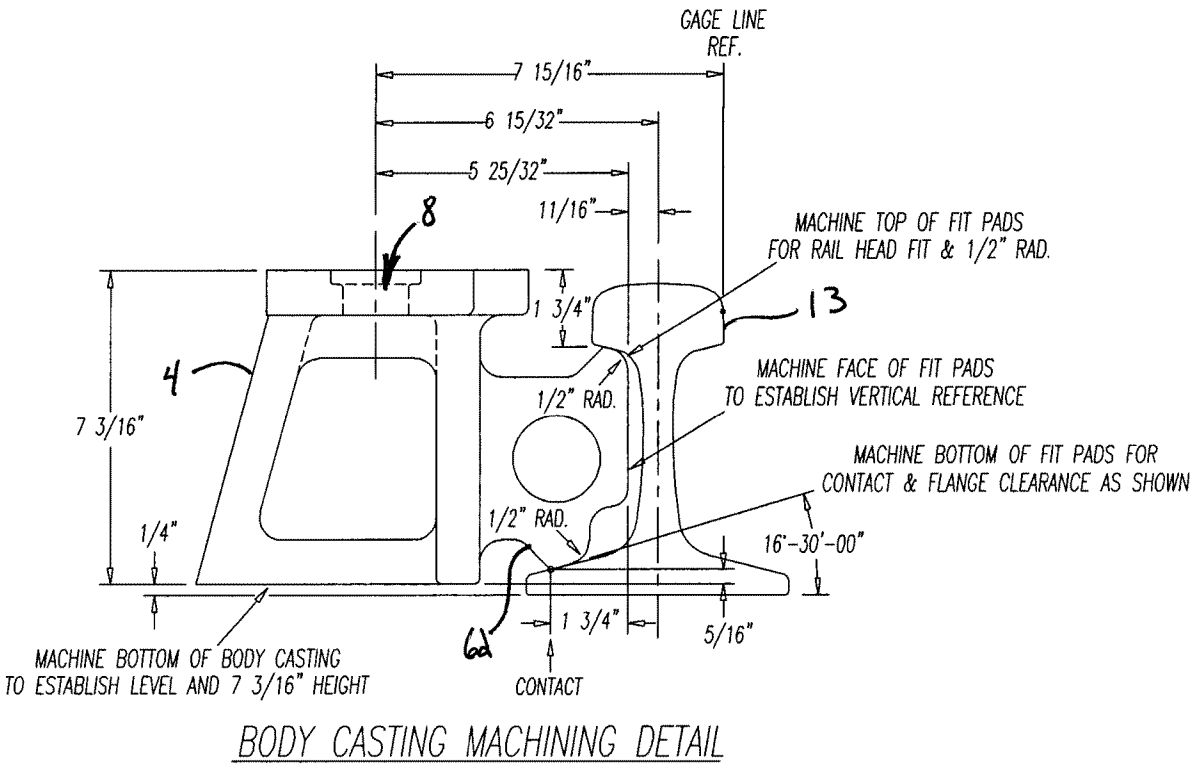
FIG. 22 is an end elevation view of the assembled switch point guard casting and support structure positioned adjacent a railroad rail, in accordance with one embodiment of the present invention.
Figure 23:
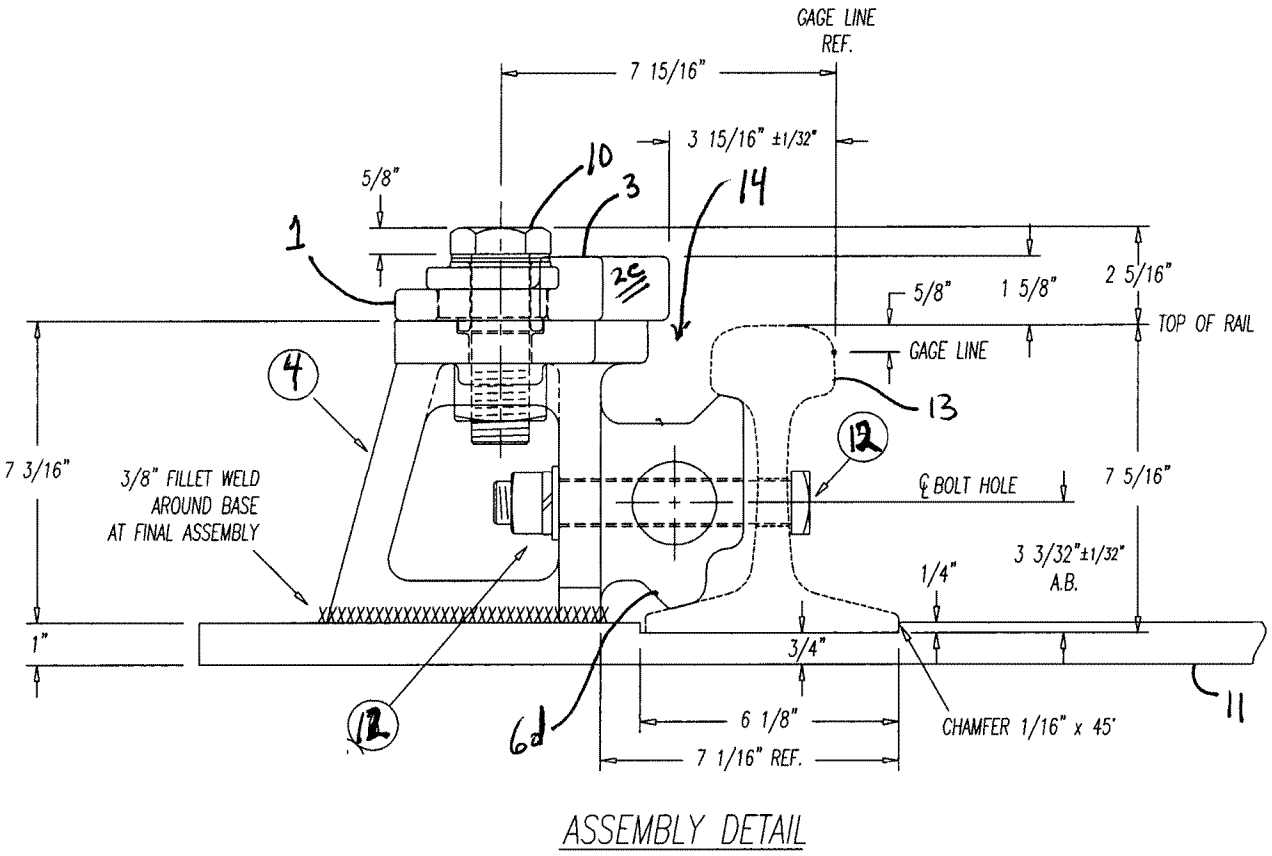
FIG. 23 is an end elevation view of the assembled switch point guard casting and support structure positioned adjacent a railroad rail, and attached to a railroad tie attachment plate, in accordance with one embodiment of the present invention.

FIG. 22 is an end elevation view of the assembled switch point guard casting and support structure positioned adjacent a railroad rail, in accordance with one embodiment of the present invention. FIG. 22 shows a body casting machining detail in an end side elevation view of the support structure 4 aside a straight rail 13, wherein like reference numerals refer to corresponding elements or features. This view shows the rail-abutting extension 6*d* and its engagement with straight rail 13. The switch point guard casting 1 is not shown in this view.

FIG. 23 shows an assembly detail in an end side elevation view of the support structure 4 aside a straight rail 13, wherein like reference numerals refer to corresponding elements or features. This view shows the rail-abutting extension 6*d* and its engagement with straight rail 13, as well as the attached switch point guard casting 1 which creates a channel 14 allowing the passage of the wheel flange of a railcar wheel. This view also shows the curved surface encountered by the side of a railcar wheel as it courses through the switch point area.

It will also be appreciated that the curved surfaces 2B and 2C allow for a somewhat tighter channel to be presented to the wheel, which lends greater wheel security while best resisting wheel lifting and potential derailment.

Figure 24:
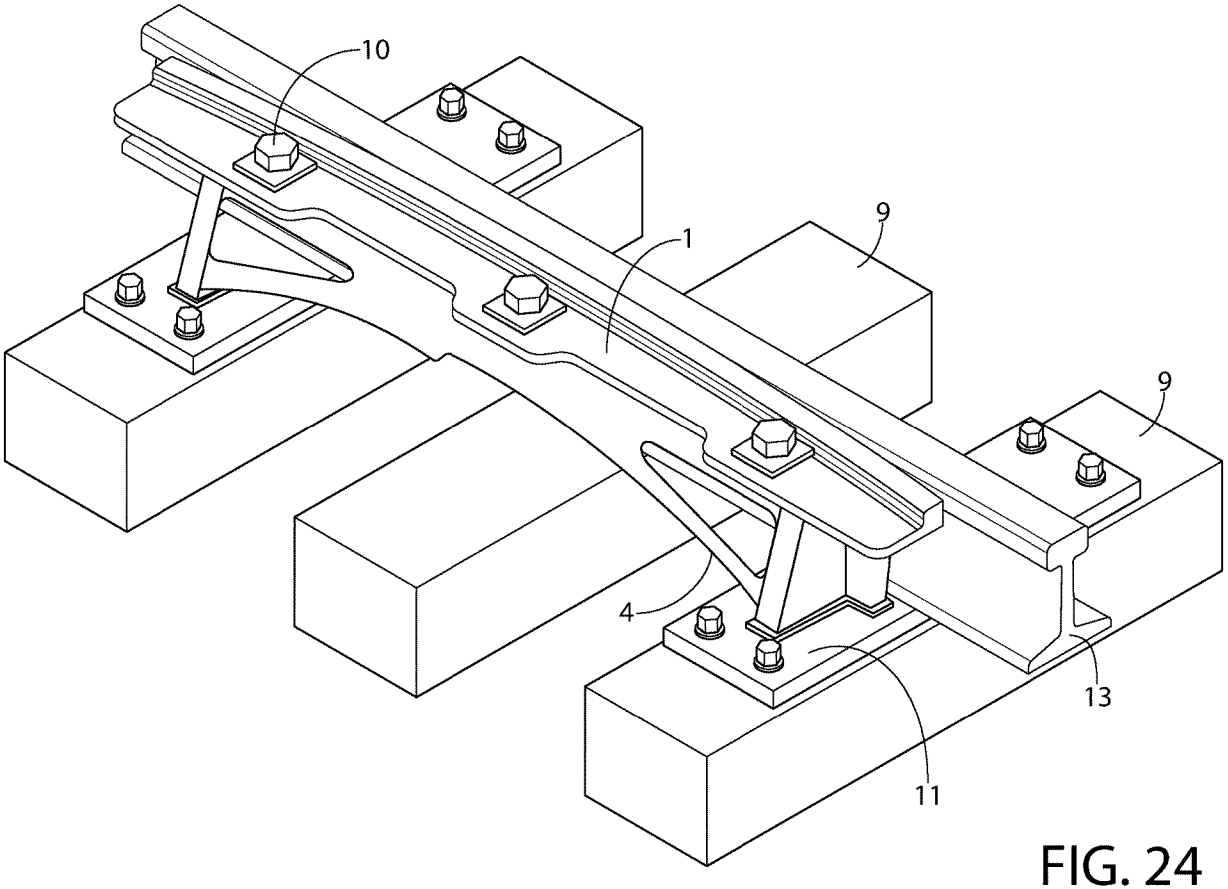
FIG. 24 is an upper perspective view of the assembled switch point guard casting and support structure, attached to railroad ties by attachment plates, in accordance with one embodiment of the present invention.

FIG. 24 is an upper perspective view of the assembled switch point guard casting and support structure, attached to railroad ties by attachment plates, in accordance with one embodiment of the present invention. FIG. 24 is an opposite side upper perspective view of the support structure 4 for a switch point guard casting 1 wherein like reference numerals refer to corresponding elements or features.

FIG. 25 is an end elevation view of the assembled switch point guard casting and support structure positioned adjacent a railroad rail, attached to a railroad tie attachment plate, and showing the position of a railcar wheel, in accordance with one embodiment of the present invention. FIG. 25 shows an assembly detail in an end side elevation view of the support structure 4 aside a straight rail 13, wherein like reference numerals refer to corresponding elements or features. This view shows the rail-abutting extension 6*d* and its engagement with straight rail 13, as well as the attached switch point guard casting 1 which creates a channel 14 allowing the passage of the wheel flange of a railcar wheel. This view also shows the curved surface 2C encountered by the outboard side of a railcar wheel 15 as it courses through the switch point area. It will be appreciated that the curved surface 2C permits the use of a narrower channel 14 because the curved surface 2C may be disposed more aggressively than typical straight surfaces, because the curved surface 2C resists wheel creep, thus proportionately reducing the risk that the railcar wheel 15 would be raised during its traversal through the switch point region. In addition, the use of a curved entry/exit surface allows the switch point guard casting 1 to be disposed relatively higher than switch point guard castings using typical straight surfaces again because the curved entry/exit surface can tolerate higher positioning without the risk of presenting, as with typical straight surfaces, a relatively large frictional profile against the railcar wheel. This allows, as in the case of the displayed embodiment, an increase in the true vertical guarding surface.

The preferred adjustable switch point guard of the present invention may incorporate several new design features that have proven to provide improved performance. The switch point guard preferably may have a relatively longer overall guard bar length of about 8 feet, with relatively longer flare lengths; i.e., each end being about 4 feet. The switch point guard of the present invention may also feature a relatively reduced flare entry angle of a 20% reduction (i.e., broadly in the range of 15%-25%). The raised guard bar height may be 5/16 of an inch higher than industry standards, giving increased guarding surface of up to a 50% increase.

Relatively larger diameter mounting bolts of 1⅜" diameter are preferred as is the use of improved bolt tightness of 1800 ft./lbs. The fixtures preferably are fittings commercially available such as Nord-Lock washers.

The outside handling holes preferably are balanced for safety purposes.

The switch point guard has been found to provide improved service life; i.e., (4) ⅛" wear cycles.

The switch point guard's support structure of the present invention may preferably be prepared from a durable one-piece cast steel body casting. The arched design not only provides strength to the assembly but it allows for installation on and over an existing center gage plate and with clearance for the existing rail brace assembly. The outside plates are pre-set to the industry standard 42" spacing which provides ease of installation on right-hand or left-hand new and existing switches. The increased height of the guard bar which provides a substantial increase in the true vertical guarding surface area. The preferred switch point guard will not have a traditional beveled end flare so as to further reduce the likelihood of wheel climbs. The three top mounted indexing inserts allow the manganese steel guard bar to be easily adjusted in track without disassembly providing four ⅛" wear cycles. The reduced flare entry angle provides less radical wheel deflections thus reducing lateral impact loads. The mounting bolts preferably are H.T.Hex Head 1⅜" dia. Grade 8 and are factory torqued to 1800 ft./lbs. and secured with Nord-Lock Washers.

Figure 26:
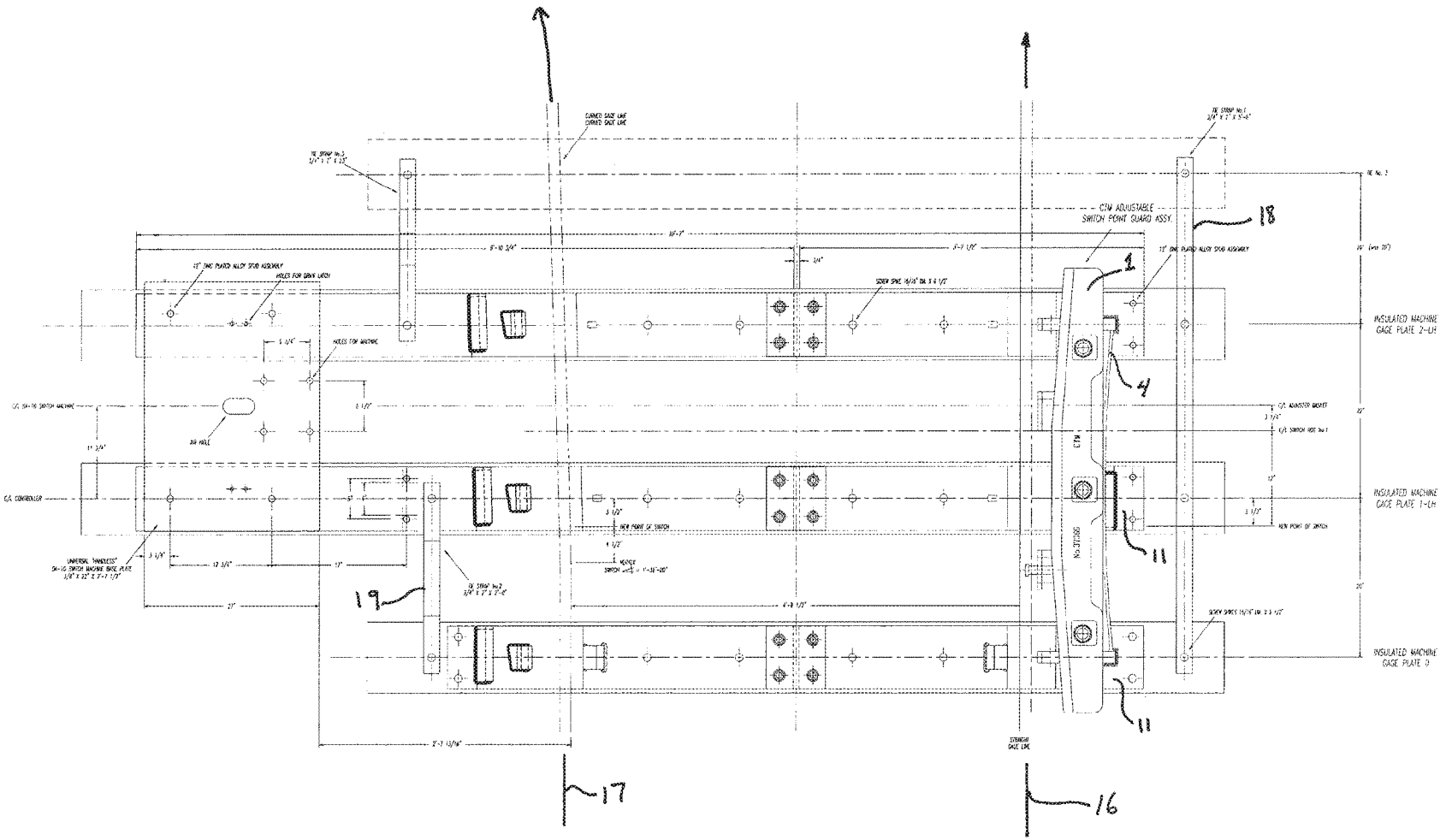
FIG. 26 is a top plan view of an assembled switch area panel with the switch point guard casting and support structure incorporated onto the railroad ties, in accordance with one embodiment of the present invention.

FIG. 26 is a top plan view of an assembled switch area panel with the switch point guard casting and support structure incorporated onto the railroad ties, in accordance with one embodiment of the present invention, and wherein like reference numerals refer to corresponding elements or features. FIG. 26 shows a full-gage switch area panel with the straight gage line 16 and curved gage line 17 indicated. The rail, such as rail 13 (not shown in this view) is laid along switch point guard casting 1 and support structure 4. Additional tie straps 18 and 19 preferably are used to secure the series of plates and ties that comprise the switch area panel.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claims, including the full range of equivalency to which each element thereof is entitled.

The following patent documents generally describe switch point guard arrangements, and such references are hereby incorporated herein by reference:

| | |
|---|---|
| 7,137,601 | Check rail device |
| 5,169,064 | Switch point guard rail |
| 5,115,970 | Switch point guard rail |
| 4,738,418 | Adjustable switch point guard |
| 4,386,751 | Switch point guard |
| 4,355,776 | Toy railroad track switch arrangement |
| 1,161,741 | Smoter |
| 1,163,431 | Maranda et al. |
| 1,230,533 | Stiles |
| 1,463,943 | Fallon |
| 1,872,848 | Told |
| 3,026,074 | Kern |
| 3,063,641 | Frey |
| 4,566,630 | Keiper |

What is claimed is:

1. A switch point guard casting comprising a main line body portion having a lateral guide surface, said lateral guide surface having, in series:

a. an entry section defining an entry section curved line, said entry section configured to encounter an outboard side of a railcar wheel running on a field side of a main line rail when said main line body portion is positioned on said field side of said main line rail;

b. a central section defining a substantially straight line; and c. an exit section defining an exit section curved line.

2. A switch point guard casting according to claim 1 wherein said entry section curved line and said exit section curved line are selected from the group consisting of continuous curvature lines and progressive curvature lines.

3. A switch point guard casting according to claim 1 wherein said entry section curved line and said exit section curved line are selected from the group consisting of continuous curvature lines with a radius in the range of from about 40 feet to about 150 feet.

4. A switch point guard casting according to claim 1 wherein said entry section curved line and said exit section curved line are selected from the group consisting of progressive curvature lines with radii varying in the range of from about 40 feet to about 150 feet.

5. A switch point guard casting according to claim 1 further comprising an attachment assembly configured to engage and attach the switch point guard casting to said main line rail through a support piece.

6. A switch point guard casting according to claim 5 wherein said attachment assembly comprises a bolt assembly.

7. A switch point guard casting and support, adapted to be attached to a series of railroad ties supporting a main line rail, comprising:

a. a switch point guard casting having a main line body portion having a lateral guide surface, said lateral guide surface having, in series:

i. an entry section defining an entry section curved line, said entry section configured to encounter an outboard side of a railcar wheel running on a field side of a main line rail when said main line body portion is positioned on said field side of said main line rail;

ii. a central section defining a substantially straight line; and iii. an exit section defining an exit section curved line;

b. a tie plate attached to two of said railroad ties; and c. a support piece attached to said switch point guard casting and adapted to be affixed to said tie plates, and to support said switch point guard casting.

8. A switch point guard casting and support according to claim 7 wherein said entry section curved line and said exit section curved line are selected from the group consisting of continuous curvature lines and progressive curvature lines.

9. A switch point guard casting and support according to claim 7 wherein said entry section curved line and said exit section curved line are selected from the group consisting of continuous curvature lines with a radius in the range of from about 40 feet to about 150 feet.

10. A switch point guard casting and support according to claim 7 wherein said entry section curved line and said exit section curved line are selected from the group consisting of progressive curvature lines with radii varying in the range of from about 40 feet to about 150 feet.

11. A switch point guard casting and support according to claim 7 further comprising an attachment assembly configured to engage and attach the support piece to said main line rail.

12. A switch point guard casting according to claim 11 wherein said attachment assembly comprises a bolt assembly.

13. A full gage railroad panel comprising a switch point guard casting and support, adapted to be attached to a series of railroad ties, comprising:

a. a railroad switch panel comprising a series of railroad ties supporting a railway switch arrangement of sufficient size to accommodate the full gage of a railroad track, said track comprising a main line rail;

b. a switch point guard casting having a main line body portion having a lateral guide surface oriented toward said running rail, said lateral guide surface having, in series:

i. an entry section defining an entry section curved line curving away from said running rail, said entry section configured to encounter an outboard side of a railcar wheel running on a field side of said main line rail when said main line body portion is positioned on said field side of said main line rail;

ii. a central section defining a substantially straight line parallel to said running rail; and iii. an exit section defining an exit section curved line curving away from said running rail;

c. a tie plate attached to two of said railroad ties; and d. a support piece attached to said switch point guard casting and adapted to be affixed to said tie plates.

14. A full gage railroad panel according to claim 13 wherein said entry section curved line and said exit section curved line are selected from the group consisting of continuous curvature lines and progressive curvature lines.

15. A full gage railroad panel according to claim 13 wherein said entry section curved line and said exit section curved line are selected from the group consisting of continuous curvature lines with a radius in the range of from about 40 feet to about 150 feet.

16. A full gage railroad panel according to claim 13 wherein said entry section curved line and said exit section curved line are selected from the group consisting of progressive curvature lines with radii varying in the range of from about 40 feet to about 150 feet.

17. A full gage railroad panel according to claim 13 further comprising an attachment assembly configured to engage and attach the support piece to said main line rail.

18. A full gage railroad panel according to claim 17 wherein said attachment assembly comprises a bolt assembly.

* * * * *